US012297635B2

(12) United States Patent
Guthrie

(10) Patent No.: US 12,297,635 B2
(45) Date of Patent: May 13, 2025

(54) BASE FOR UNIVERSAL SLIDE STYLE FLOAT AND ASSEMBLY

(71) Applicant: Kevin J Guthrie, Wind Lake, WI (US)

(72) Inventor: Kevin J Guthrie, Wind Lake, WI (US)

( * ) Notice: Subject to any disclaimer, the term of this patent is extended or adjusted under 35 U.S.C. 154(b) by 0 days.

(21) Appl. No.: 17/988,488

(22) Filed: Nov. 16, 2022

(65) Prior Publication Data

US 2023/0071103 A1 Mar. 9, 2023

Related U.S. Application Data

(63) Continuation-in-part of application No. 16/844,093, filed on Apr. 9, 2020, now abandoned.

(60) Provisional application No. 62/831,389, filed on Apr. 9, 2019.

(51) Int. Cl.
*E03D 1/35* (2006.01)

(52) U.S. Cl.
CPC ..... *E03D 1/35* (2013.01)

(58) Field of Classification Search
CPC ... E03D 1/33; E03D 1/35; F16K 33/00; F16K 31/20
USPC ..... 4/395–404
See application file for complete search history.

(56) References Cited

U.S. PATENT DOCUMENTS 8,112,829 B2 * 2/2012 Shieh ..... E03D 1/34 4/399
11,286,655 B2 3/2022 Smith et al.
2020/0263405 A1 * 8/2020 Smith ..... E03D 1/33

* cited by examiner

*Primary Examiner* — Tuan N Nguyen
(74) *Attorney, Agent, or Firm* — Amundsen Davis, LLC

(57) ABSTRACT

A float comprises an outer float wall, an inner guide, and a float base. The float base further comprises an outer perimeter and a disk portion. The disk portion includes a central aperture to allow the float base to move with respect to a sleeve. A plurality of apertures are formed within the disk structure. In addition, a structure is formed within the float base to allow the float base to be captured within a bottom portion of the float at a fastening structure.

3 Claims, 12 Drawing Sheets

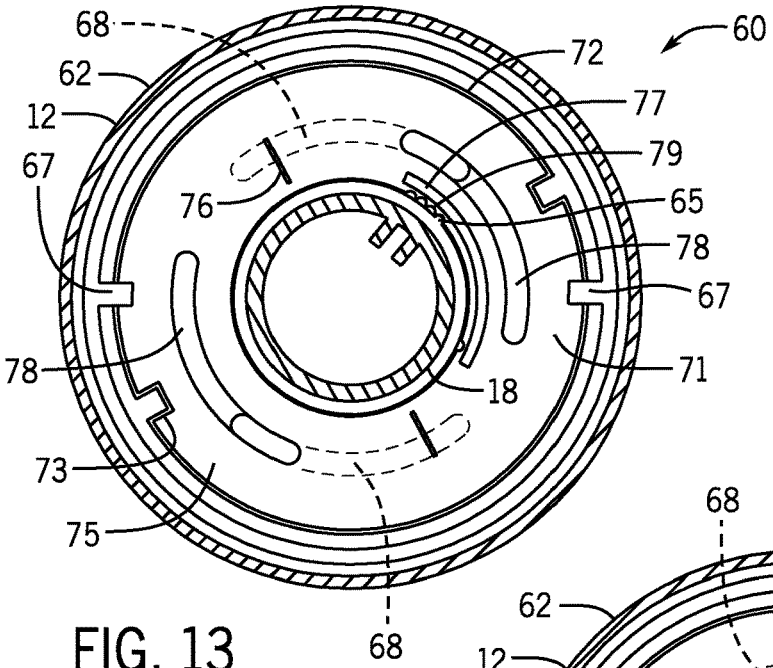
FIG. 13
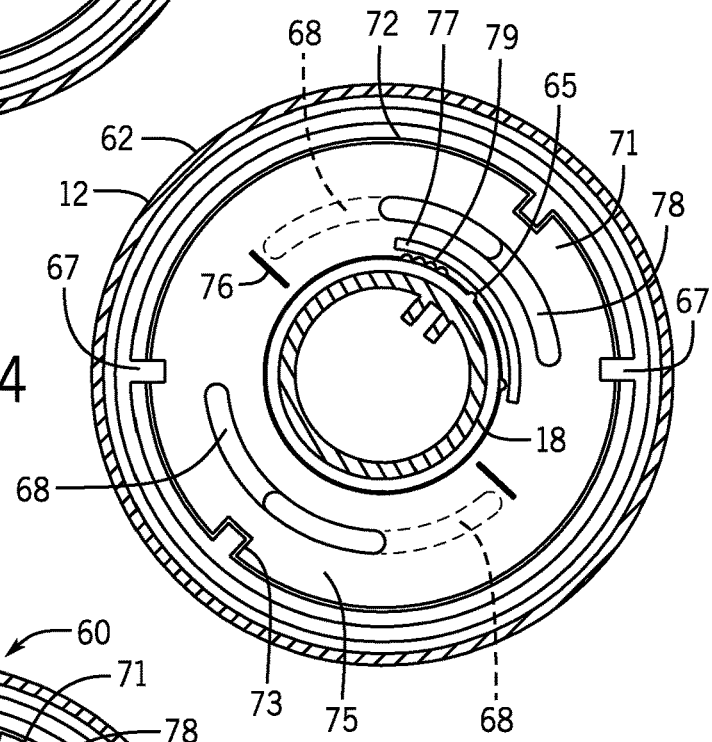
FIG. 14
FIG. 15
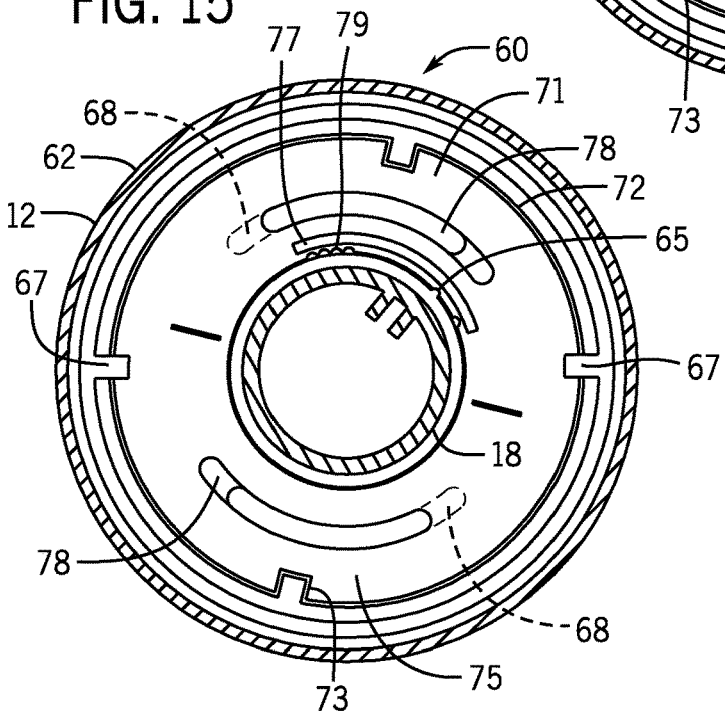

BASE FOR UNIVERSAL SLIDE STYLE FLOAT AND ASSEMBLY

PRIORITY CLAIM

This application is a continuation-in-part of U.S. application Ser. No. 16/844,093 filed Apr. 9, 2020, which application claims priority to U.S. Provisional Patent Application No. 62/831,389, filed Apr. 9, 2019, the contents of which are hereby incorporated by reference.

FIELD OF THE INVENTION

The present invention relates generally to indoor plumbing and gravity-operated flush toilets. The present invention also relates generally to flush valves of the type having a hollow slide float that controls operation of the valve during a flush cycle. More particularly, the present invention relates to a base for use with a slide style float. The float base has openings defined within it to selectively control the closure timing of the valve. The base openings can assume a number of configurations.

BACKGROUND OF THE INVENTION

Conventional gravity-operated flush toilets have several basic components. The porcelain or china components include a bowl and a water tank mounted on top of a rear portion of the bowl. The bowl and tank can be separate pieces that are bolted together to form a two-piece toilet. Other gravity-operated flush toilets are made as a one-piece toilet, in which the bowl and tank are made as one continuous, integral piece of china.

More importantly, the plumbing components of a gravity-operated flush toilet include a fill valve in the tank, which is connected to a water supply line, a flush valve surrounding a drain hole in the bottom of the tank that communicates with the bowl, and a flapper valve that normally closes and seals the flush valve or, more precisely, the main flush valve orifice.

In the prior art, one particular type of flush valve has a dedicated float that mounts onto a main seal. When the trip lever is depressed, the float is raised along a float guide and the seal unseats to allow water to flow from the tank to the bowl. This configuration is colloquially referred to as a "tower" style flush valve. The goal of the structure of tower style flush valves is to maximize water flow efficiency and timing while simultaneously minimizing water wastage.

In the float described herein, the float is generally filled with air. When water enters the float, the float air volume is evacuated or displaced. This makes it an "open float" design. Further, one or more small holes or apertures can be made in the float. When the float is pulled upwardly during a flush cycle, water in the tank can flow through the holes or apertures and into the interior of the float. This increases the overall mass of the float, causing it to sink at an increased rate so as to shorten the closure time of the valve. The size and quantity of the openings can be selected to achieve a closure rate that corresponds to a desired water consumption. In flush valves of this type and of current manufacture, the openings are non-adjustable as made by the original equipment manufacturer (OEM) float to optimize performance for that particular flush valve. This prevents the end user from making any adjustment to the float holes or apertures. This is a particularly problematic situation where a replacement flush valve is chosen by the user because there is virtually no interchangeability between the floats and the apertures or holes defined in them. That is, use of a float that is configured for one flush valve may not function optimally when used in another flush valve. Further, at a retail level, a retailer is required to carry a great multitude of flush valves, since each flush valve has its specific float and float opening requirements. This creates a substantial overstocking and inventory problem.

In view of the foregoing, there is a need for a singular float having flow adjustment means that can be used within a wide variety of flush valves. There is further a need for a bottom wall float structure that allows a user to replace the bottom wall of the float with a bottom wall having a variety of ways to "adjust" the flow capacity that optimizes performance of the flush valve (hence use of the alternative word "adjuster" herein). The float bases that are configured in accordance with the present invention fulfill this need.

SUMMARY OF THE INVENTION

In view of the foregoing, a primary objective of the device of the present disclosure is to provide a new, useful, and non-obvious float base that allows for variability in settings so as to maximize flow capacity of the float. As used herein, the term "float base" may also be referred to as an "adjuster", the term and word identifiers being used interchangeably in the detailed description that follows. The float base of the present disclosure may be used as an OEM part of a flush valve assembly or as a stand-alone replacement for a float of the type described above. As an after-market replacement, the float base of the present disclosure allows for custom flow settings, depending on the flush valve model originally provided, while also eliminating the need to create a substantially larger number of pre-customized replacement parts for purchase by the consumer.

The foregoing and other features of the float base of the present disclosure will be apparent from the detailed description that follows.

BRIEF DESCRIPTION OF THE DRAWINGS

FIG. 13 is a bottom plan view of the float base shown in FIG. 11 with the rotatable portion of the base shown in a second position.

FIG. 14 is a bottom plan view of the float base shown in FIG. 11 with the rotatable portion of the base shown in a third position.

FIG. 15 is a bottom plan view of the float base shown in FIG. 11 with the rotatable portion of the base shown in a fourth position.

DETAILED DESCRIPTION

Figure 1:
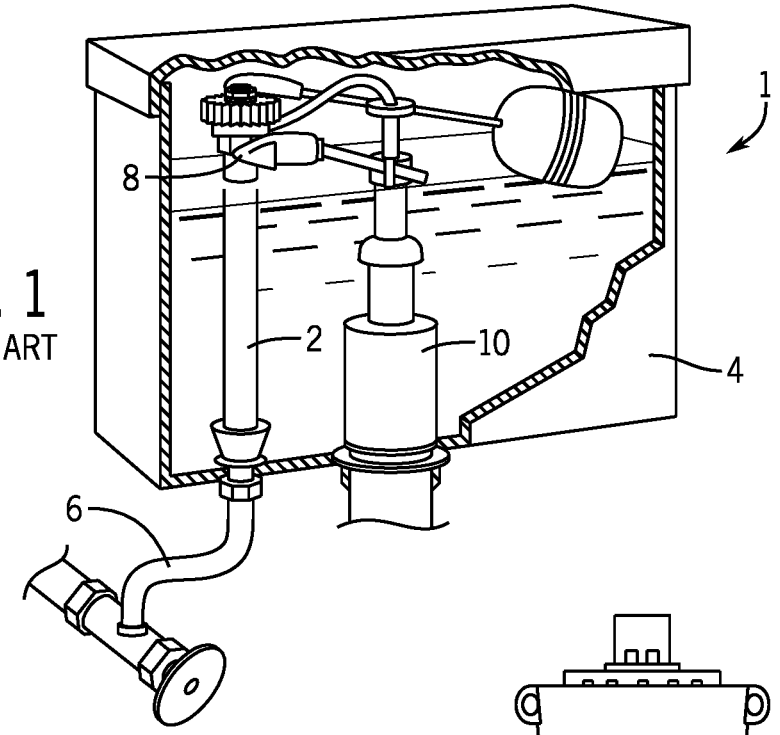
FIG. 1 PRIOR ART
FIG. 1 is a partially sectioned and perspective view of a toilet tank of the type in which the float base of a float that is part of a flush valve is constructed in accordance with the present disclosure.
Figure 2:
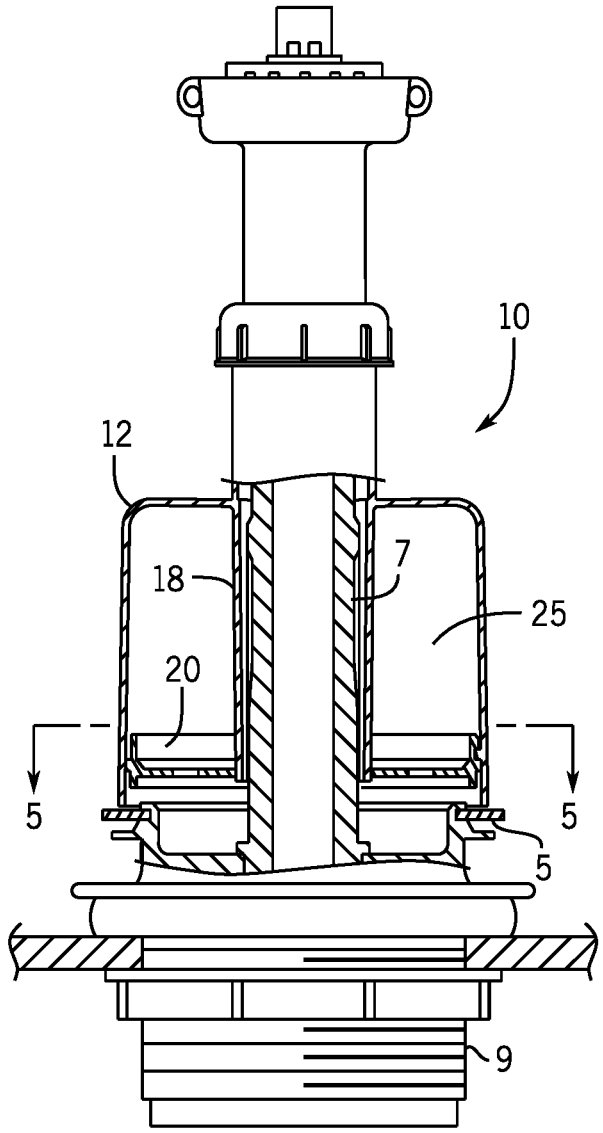
FIG. 2 is a side elevation view of the flush valve used in the toilet tank shown in FIG. 1 and illustrating the flush valve in a "closed" or water no-flow position.

Referring now to the drawings in detail, wherein like-numbered elements refer to like elements throughout, FIG. 1 shows an environment within which the float base is used. Specifically, a gravity-operated flush toilet assembly 1 is provided. The gravity-operated flush toilet assembly 1 comprises a water tank 4 mounted on top of a rear portion of a bowl (not shown) and a water tank cover (partially shown). Water from tank 4 empties into the bowl when a flush lever 8 is pushed downwardly and the flush valve, generally identified 10, is actuated via a linkage between the lever 8 and the flush valve 10. These elements are well-known in the art.

FIGS. 2 through 7 show the details of a first embodiment of a float base, generally identified 20, consistent with the present disclosure. The float base 20 is used with the open float 12 of a flush valve 10 of the type used in the tank 4, illustrated in FIG. 1. A tower base 9 is provided, the tower base 9 comprising a float guide 7 and a main seal 5. As is best shown in the cut-away view illustrated in FIG. 3, the float 12, which is an open float, comprises an inner sleeve or wall 18. This inner wall 18 is movable along the float guide 7 of the tower base 9. The inner wall 18 comprises a float vent slot 19, which forms part of the water flow continuum through the flush valve 10. The float 12 further comprises an outer float wall 14 having an inner surface 13 and an outer surface 15. The bottom 16 of the float wall 14 is substantially circular, but is not limited to that shape, nor is the float 12. The inner surface 13 of the float wall 14 includes a bayonet-type fastening structure 17. Further shown, the bottom 16 of the float 12 is open. The void 25 created at this bottom opening is bounded by the float base 20, as will be apparent from this detailed description.

Figure 3:
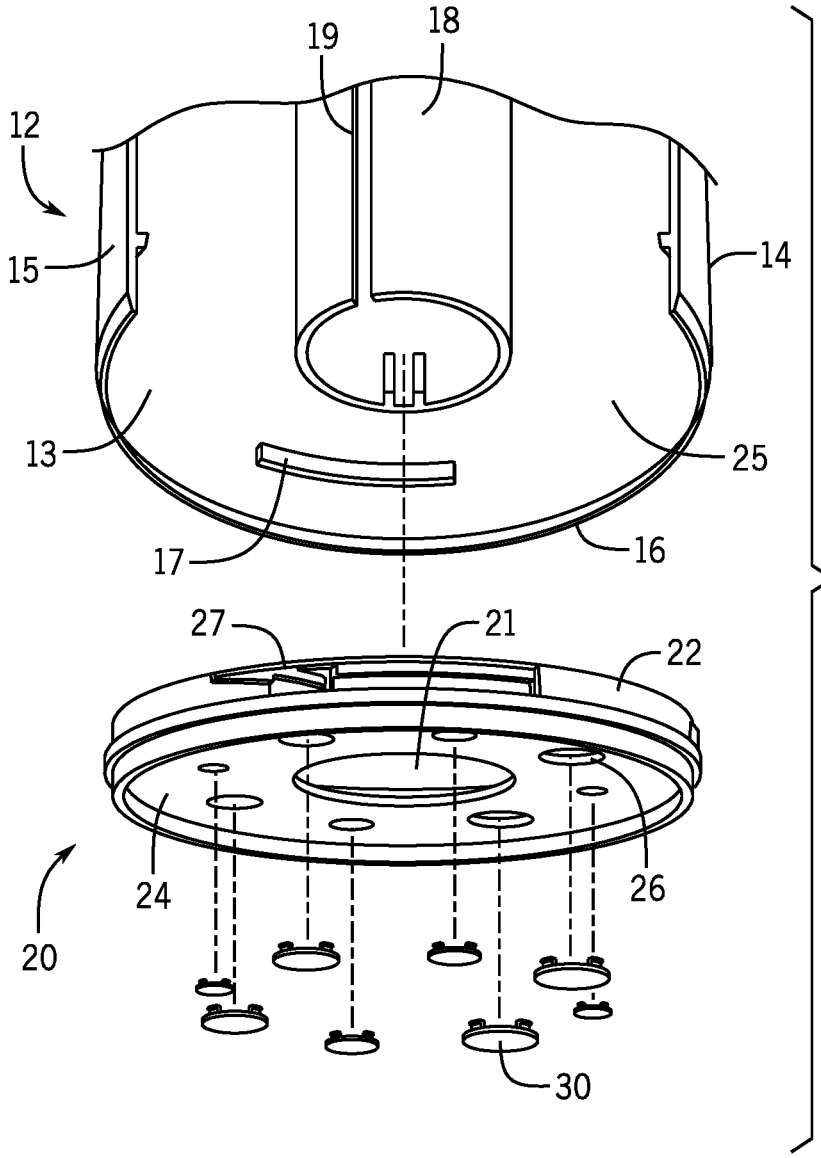
FIG. 3 is an enlarged front perspective and exploded view of the lower portion of the flush valve float shown in FIG. 2 illustrating a first embodiment of a float base used with the float.

Continuing with FIG. 3, the float base 20 comprises a substantially circular structure. The float base 20 is not limited to that shape, however; instead, the float base 20 should substantially match the shape of the bottom 16 of the float wall 14, as the two structures are intended to be coupled together, as will be discussed further herein. The float base 20 comprises an outer perimeter 22 and a centrally-disposed and substantially flat disk portion 24 that lays fully within the confines of the outer perimeter 22. The central disk portion 24 has a uniform thickness and, in application, is disposed in a substantially horizontal position. As shown, the disk portion 24 comprises a centrally-disposed aperture 21 that is sized to allow movement of the float base 20 along a sleeve (not shown) of the flush valve 10. Also formed within the disk portion 24 is a plurality of differently-sized and substantially circular plug-receiving apertures 26. Each aperture 26 comprises an aperture perimeter 28 and an aperture perimeter edge or corner 29. See FIG. 7. Each such aperture 26 is sized to accept a complementary plug, generally identified 30, of the type shown in FIG. 4. Lastly, the float base 20 comprises a complementary structure 27 that allows the float base 20 to be captured within the bottom of the float via the bayonet-type fastening structure 17 of the float 12. It is to be understood, however, that this is not the only way in which the float base 20 and the float 12 can be coupled together.

Figure 4:
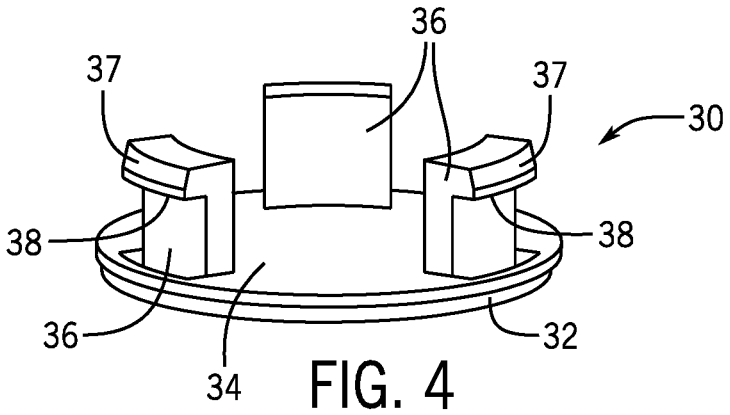
FIG. 4 is a greatly enlarged top and front perspective view of a plug that is used in a first embodiment of the float base shown in FIG. 3.
Figure 5:
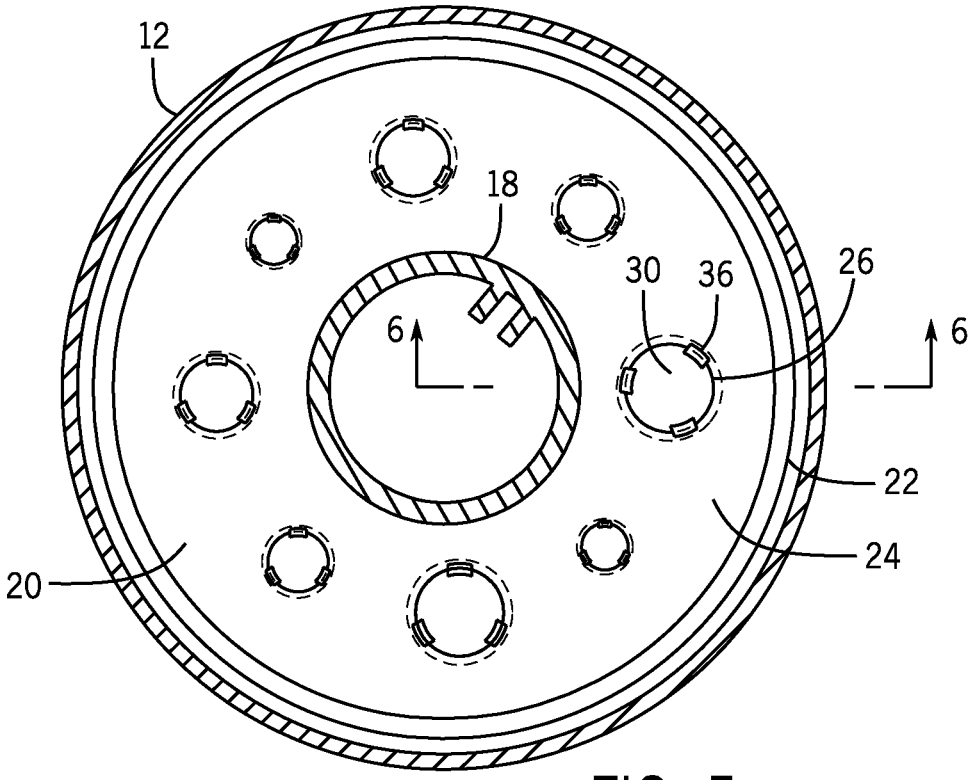
FIG. 5 is a top plan view of the float and float base taken along line 5-5 of FIG. 2.
Figure 6:
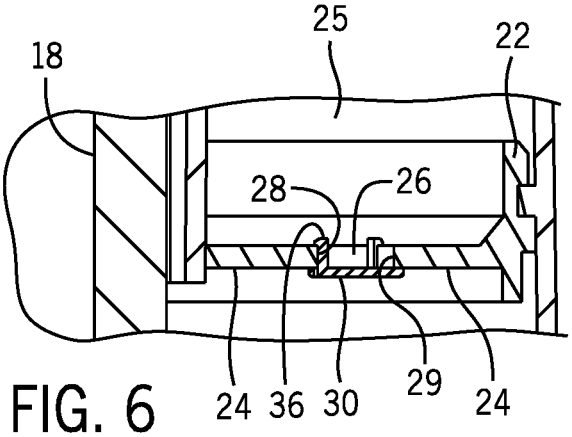
FIG. 6 is an enlarged cross-sectioned view of the float and float base taken along line 6-6 of FIG. 5 and showing a plug that is inserted into an aperture defined in the float base.
Figure 7:
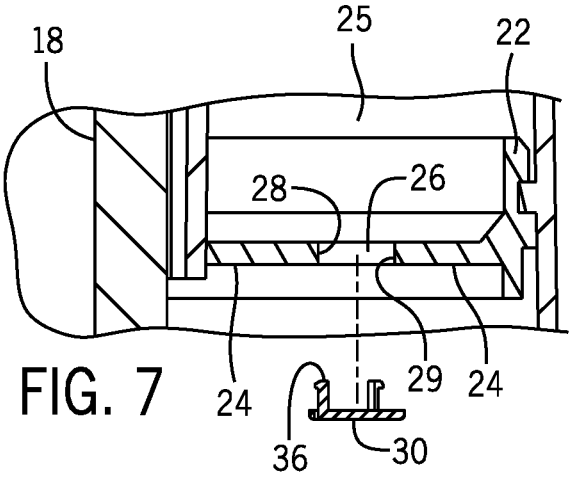
FIG. 7 is a view similar to FIG. 6 but showing the plug prior to insertion into the aperture defined in the float base.

As shown in FIG. 4, each plug 30 comprises a substantially flat bottom portion 32. The flat bottom portion 32 further has a substantially flat top surface 34. Extending upwardly from this top surface 34 is a plurality of fingers 36. Each finger 36 comprises an upper angled outer edge 37 and an outwardly-extending lip 38. The lip 38 is intended to lay in a substantially horizontal plane. Further, the distance from the top surface 34 of the plug 30, which also lays in a substantially horizontal plane, to the lip 38 substantially matches the thickness of the disk portion 24 of the float base 20.

Each plug 30 is comprised of a material that has some elasticity and memory to it. That is, each plug 30 is constructed of a material that allows the fingers 36 of the plug 30 to be pushed or flexed inwardly and then return substantially to a pre-flexed position. In this way, the fingers 36 can be pushed into contact with the corresponding perimeter edge 29 of a correspondingly-sized plug-receiving aperture 26 of the float base 20. As the plug 30 is urged upwardly, an angled outer edge 37 of the finger 36 engages the edge 29 of the aperture perimeter 28, which, in turn, pushes each finger 36 inwardly. Once the fingers 36 are pushed inwardly a sufficient distance (i.e., a distance equal to the thickness of the disk portion 24), the outwardly-extending lip 38 of each finger 36 catches the edge 29 of the aperture perimeter 28. This is accomplished by the lip 38 returning to its pre-flexed position, thereby capturing the plug 30 within one of the plurality of differently-sized and substantially circular plug receiving apertures 26. The size of the aperture 26 and the corresponding plug 30 is a function of the floatation parameters required for the particular flush valve 10 and its float 12. See FIGS. 5-7 relative to insertion of a number of plugs 30 into a corresponding aperture 26. That is, the end user can add or subtract plugs 36 as required by the particular flush valve 10 being used. In use, the open apertures 26 of the float base 20 are used to meter water flow, as well as air flow, through the vertical slot 19.

Figure 8:
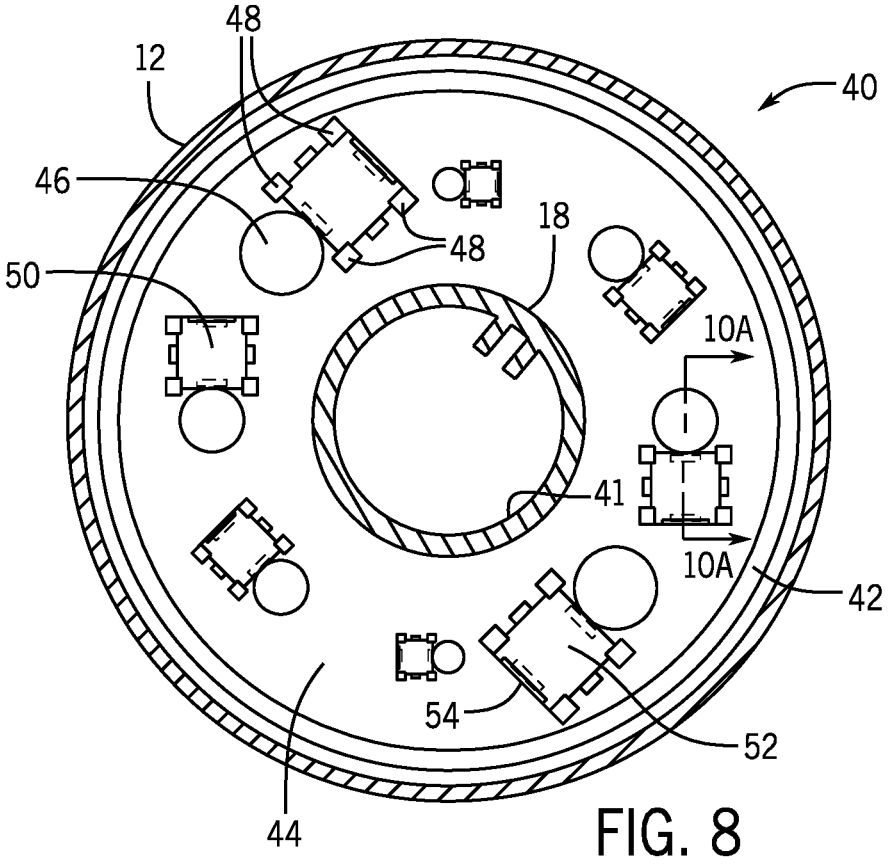
FIG. 8 is a bottom plan view of the float and a second embodiment of a float base and further illustrating all apertures defined in the float base as being open.
Figure 9:
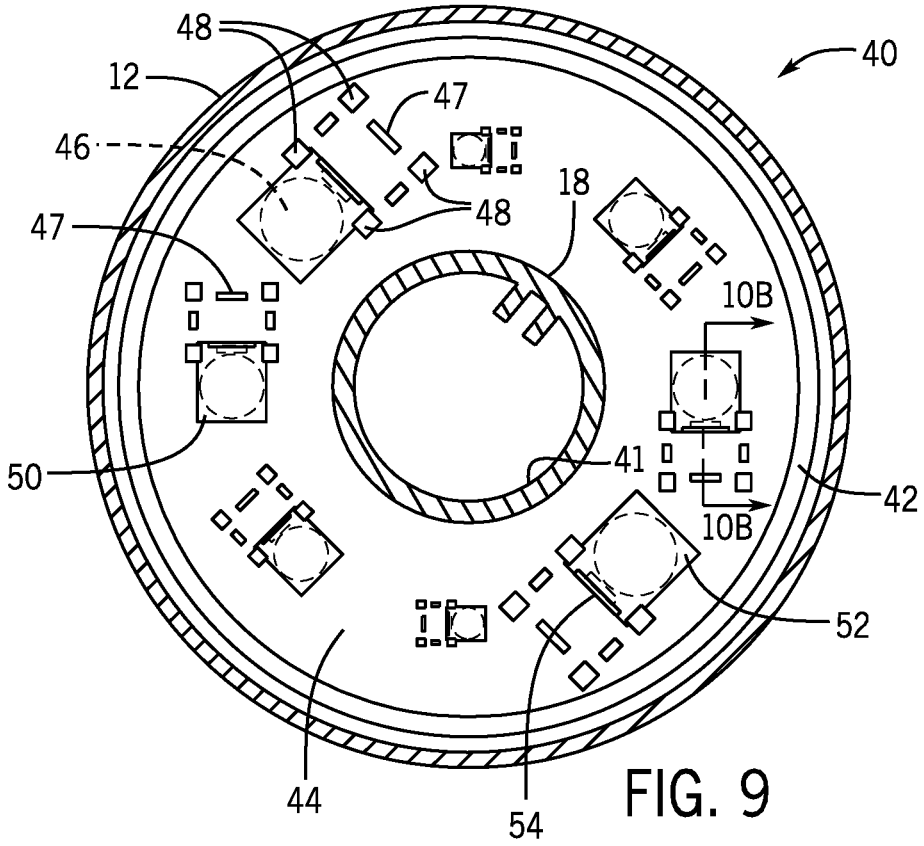
FIG. 9 is a view similar to FIG. 8 but showing all apertures being closed.
Figure 10A:
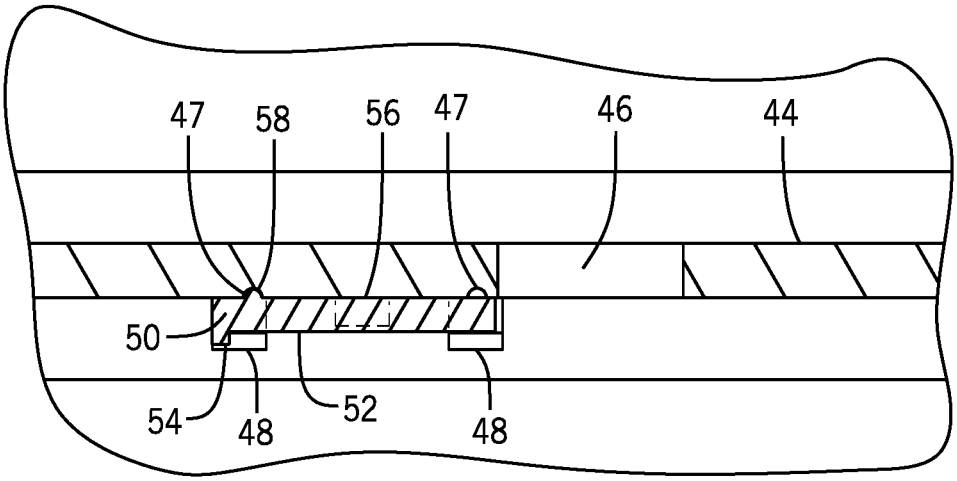
FIG. 10A is an enlarged cross-sectioned view of the float base and cover, with the cover shown in the open position, taken along line 10A-10A of FIG. 8.
Figure 10B:
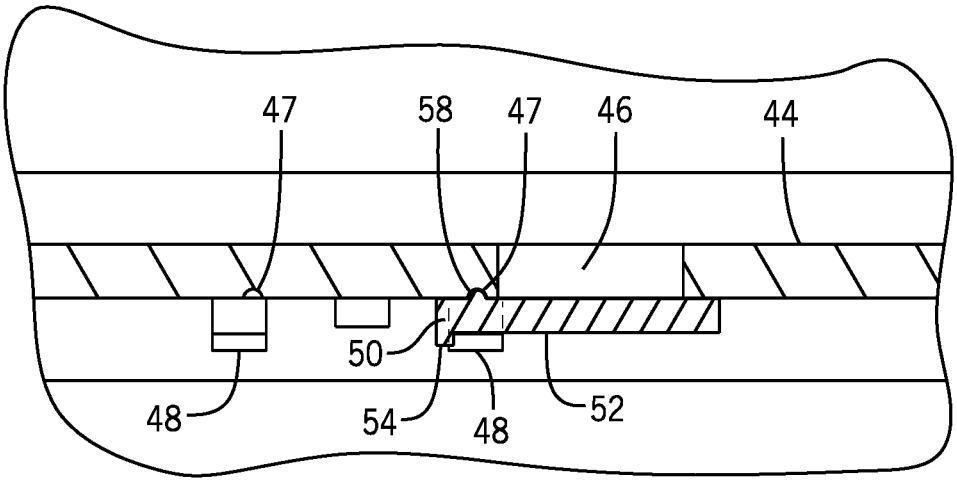
FIG. 10B is a view similar to that shown in FIG. 10A but showing the cover in the closed position, taken along line 10B-10B of FIG. 9.
Figure 11:
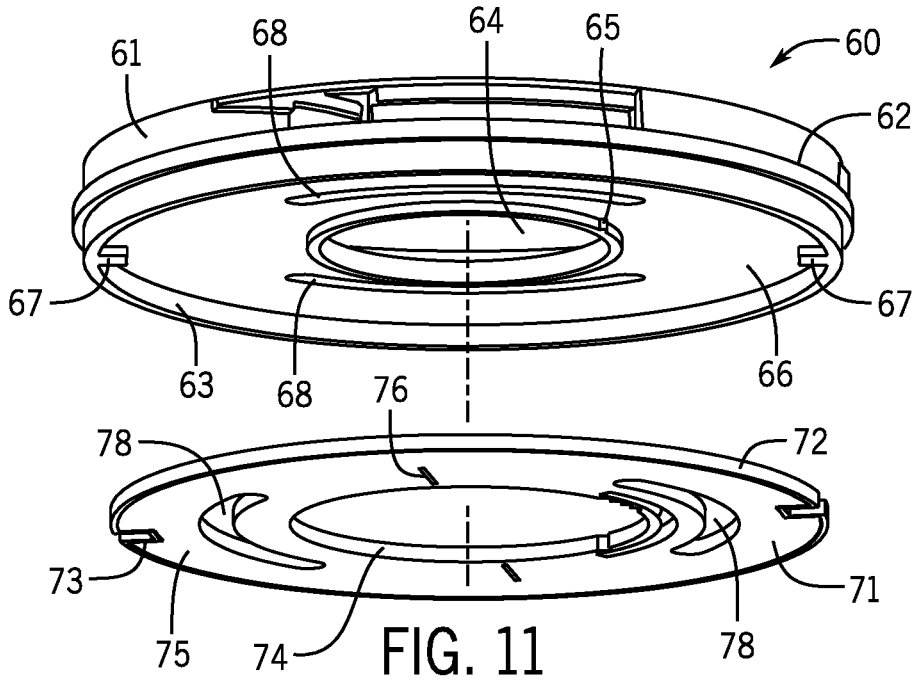
FIG. 11 is an exploded front and bottom view of a third embodiment of a float base consistent with the present disclosure.
Figure 12:
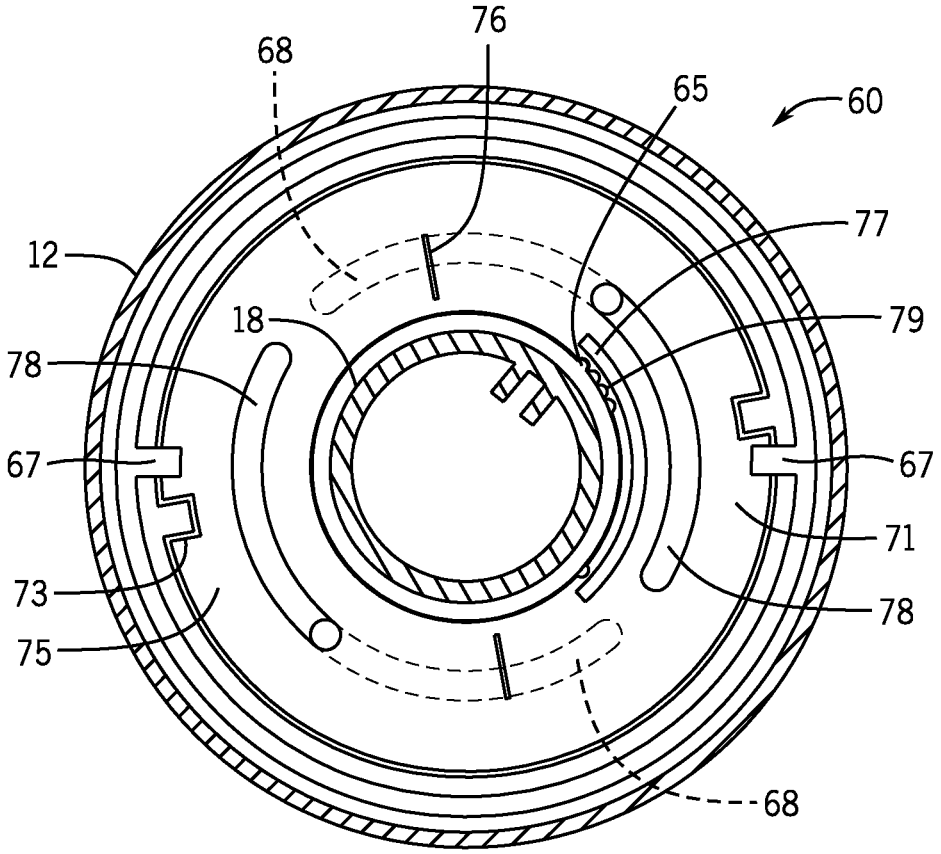
FIG. 12 is a bottom plan view of the float base shown in FIG. 11 with the rotatable portion of the base shown in a first position.

FIGS. 8, 9, 10A, and 10B illustrate a second embodiment of a float base, generally identified 40. FIGS. 8 and 9 are bottom plan views of the same base 40. Much like the first embodiment, the float base 40 comprises an outer perimeter 42 and a centrally-disposed and substantially flat disk portion 44 that extends fully within the confines of the outer perimeter 42. The central disk portion 44 has a uniform thickness; however, the particular thickness of the central disk portion 44 does not significantly impact the functionality of the float base 40 (unlike with the first embodiment described previously). As shown, the disk portion 44 further comprises a centrally-disposed aperture 41. The aperture 41 is sized to allow movement of the float base 40 along a sleeve (not shown) of the flush valve 10.

A plurality of differently-sized apertures 46 are also formed within disk portion 44. Although the apertures 46 are substantially circular in FIGS. 8 and 9, examples are not so limited, and the apertures 46 may be any shape. Adjacent to each aperture 46 is a capturing structure. The capturing structure comprises a plurality of alignment fingers 48 positioned along each aperture 46 such that a slide cover, generally identified 50, is guided and captured within the alignment fingers 48. A pair of receivers 47 is formed near each set of alignment fingers 48.

Each cover 50 comprises a flat body portion 52 and a downwardly-extending lip 54. See also FIGS. 10A and 10B. A user can use the lip 54 to push any of the slide covers 50 over an adjacent aperture 46. Here again, the size of the aperture 46 and the corresponding slide cover 50 is a function of the floatation parameters desired or required by a particular flush valve 10 and its float 12. As with the first embodiment, the end user can open or close off any combination of apertures 46 by moving the slide covers 50 as required by the particular flush valve 10 being used. In use, the open apertures 46 of the float base 20 are used to meter water flow, as well as air flow, through the vertical slot 19.

Each slide cover 50 is held in either the open or close position by engagement of a detent 58 that is defined within the upper surface 56 of the cover 50. The slide cover 50 can be held in either position by engagement of the detent 58 with one of the receivers 47. For covering an aperture 46, the detent 58 engages the receiver 47 closest to the aperture 46. For uncovering an aperture 46, or keeping it open to water flow, the detent 58 engages the receiver 47 that is furthest away from the aperture 46. In either instance, the engagement by the detent with a receiver 47 allows for the slide cover 50 to remain in its open or closed position, as required by the functional requirements of the particular float 12 being used.

FIGS. 11-15 illustrate a third embodiment in which a dial adjustable portion is utilized. More particularly, the float base, generally identified 60, is comprised of a first base member 61; the first base member 61 comprises an outer perimeter 62, an inner perimeter 63, and a centrally-disposed and substantially flat disk portion 66. A second base member or "adjuster" 71 is also provided. The central disk portion 66 of the first base member 61 has a uniform thickness; however, the particular thickness of the portion 66 does not significantly impact the functionality of the float base 60.

The outer perimeter 62 further comprises a pair of inwardly-projection and opposing retention tabs 67, which form a capture structure. Although two retention tabs 67 are shown, examples are not so limited and other numbers of retention tabs 67 may be used. In addition, a positioning tab 65 extends outwardly from the inner perimeter 64. Two opposing radial openings 68 are also formed within the disk portion 66.

Float base 60 uses a combination of the first base member 61 and the second base member 71 to meter water flow, as well as air flow, through the vertical slot 19 (as with float bases 20, 40, discussed with respect to FIGS. 1-10B). The second base member 71 comprises a top surface 73 and a bottom surface 75. The top surface 73 is intended to be placed adjacent to the bottom face 63 of the first base member 61 when the second base member 71 is held in place by the retention tabs 67.

The second base member 71 includes an outer perimeter 72 and an inner perimeter 74. In this embodiment, outer perimeter 72 is a stand-off rib and further comprises a pair of opposing slots 73. Slots 73 allow the second base member 71 to be placed adjacent to the first base member 61 via the retention tabs 67, which then allows the second base member 71 to be rotated. That is, the second base member 71 is installed when the slots 73 line up with the retention tabs 67.

The second base member 71 further comprises two opposing radial openings 78. Radial openings 78 are similarly sized and positioned to overlay, or to partially overlay, the radial openings 68 of the first base member 61. Moreover, the second base member 71 includes a pair of ridges 76 at the bottom surface 75; the ridges 76 allow the user to rotate the second base member 71 to a required position. Further, the second base member 71 has a third arcuate slot 77. Arcuate slot 77 effectively provides a spring that allows the positioning tab 65 to selectively engage positioning openings 79 that are disposed along the inner perimeter 74. When the positioning tab 65 engages with positioning openings 79, arcuate slot 77 adds a small amount of side load force. The positioning openings 79 may be numbered or lettered to match specific settings for different brands and/or models of toilets.

Figure 16:
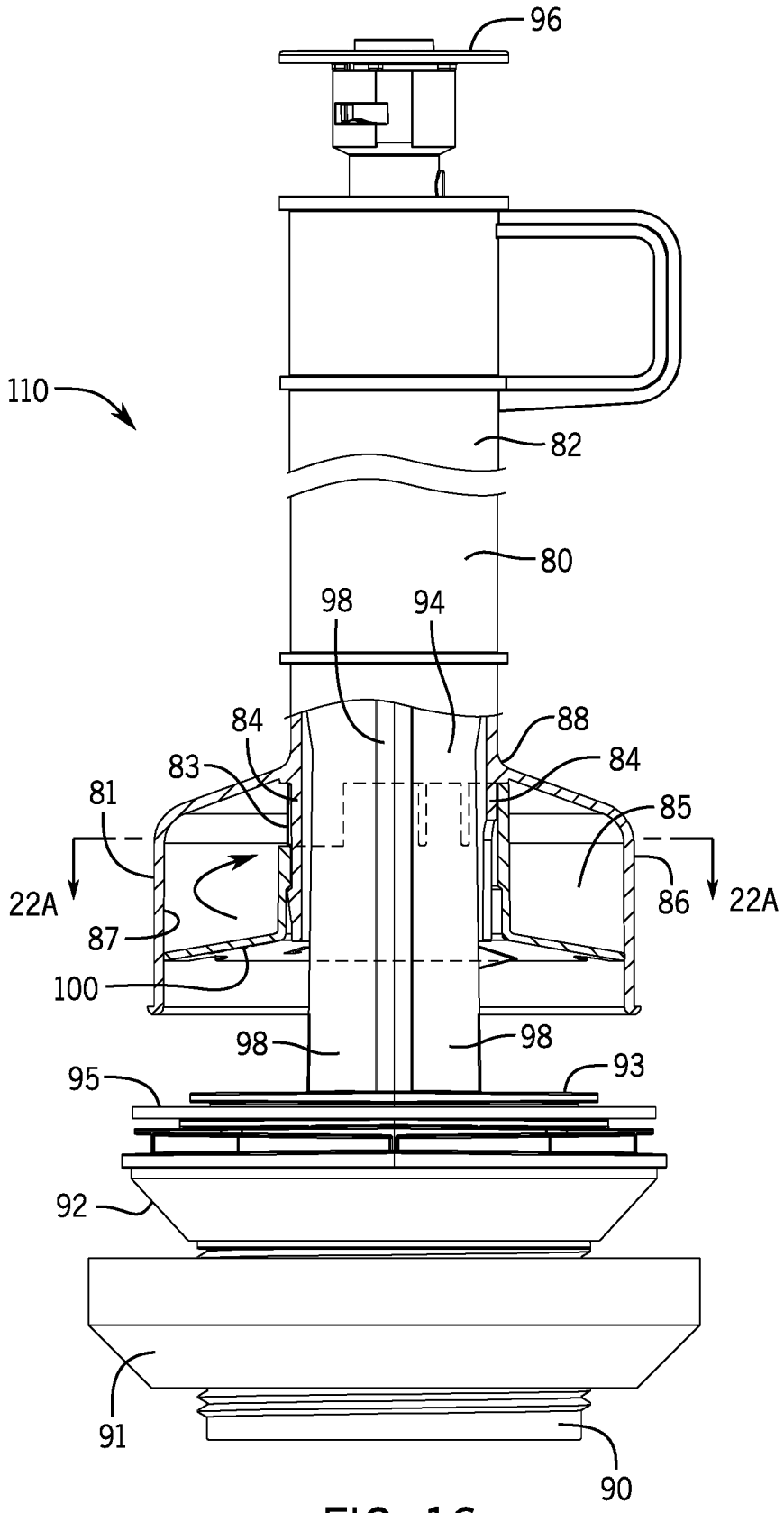
FIG. 16 is a partially cross-sectioned view of a tower assembly in accordance with the present invention.

Referring now to FIG. 16, it illustrates an adjustable tower assembly, generally identified 110, that is constructed in accordance with the present invention. The adjustable tower assembly 110 incorporates a vertically movable tower body 80 and a stationary tower base 90. The tower base 90 comprises additional structure, such as a tank to bowl gasket 91, a tower base seal 92 and a valve gasket 95 and a mounting nut (not shown), which allows the tower base 90 to be mounted at the outlet of a toilet tank 1. The tower base 90 includes an retention portion 93 of the base 90 that is mounted within the toilet tank 1 outlet (not shown). See FIG. 1. The valve gasket 95 is disposed atop the base 90. The purpose of this valve gasket 95 will be apparent later in this detailed description. Extending upwardly from this seated portion 93 is a vertical slide portion 94 that terminates at a retainer stop 96. The vertical slide portion 94 is formed to create a "virtual" diameter, which is accomplished by providing a set of upwardly extending X-shaped structures which result in having four points of contact, each point of contact being separated by 90°. Three of these points 98 are shown in FIG. 16. The retainer stop 96 is provided to limit the upward travel of the tower body 80 when the toilet is used during a flush cycle.

Continuing with FIG. 16, it can be seen that the tower body 80 has an upper walled portion 82, a first lower walled portion 84 and a second lower walled portion 86. The tower body 80 is constructed such that it comprises a walled cylindrical structure having a uniform inner diameter extending from the upper portion 82 to the first lower portion 84. This uniform inner diameter is only slightly more than the virtual diameter created by the points 98 of the vertical slide portion 94 of the tower base 90 as previously described. In this way, the tower body 80 can move vertically along the vertical slide portion 94 of the tower base 90. It can also rotate about this vertical slide portion 94, although rotation is not intended once the assembly 110 is fully assembled and mounted within the tank 4. The first lower walled portion 84 comprises an outer surface 83. Moving downwardly along the outer surface 81 of the tower body 80, the diameter of the outer surface 81 begins to deviate away from the tower body 80 at a point 88 thereby creating a second lower walled portion 86 of the tower body 80. This configuration creates a significant void 85 about the first lower walled portion 84 of the tower body 80, the first lower walled portion 84 of the tower body 80 extending into the void 85. This void 85 is bounded on its top and continuously cylindrical side by the second lower walled portion 86 that comprises a walled inner surface 87 which is also cylindrical in shape but has a diameter that is substantially greater than that of the first lower walled portion 84 of the tower body 80. As shown in FIG. 16, the diameter of the outer walled portion 86 is sized so as to allow the outer walled portion 86 to seal with the tower base seal 95 because it is similarly sized. Disposed within the void 85 is an adjuster 100. Again, the word "adjuster" is synonymous with the term "float base" in this detailed description.

Figure 17:
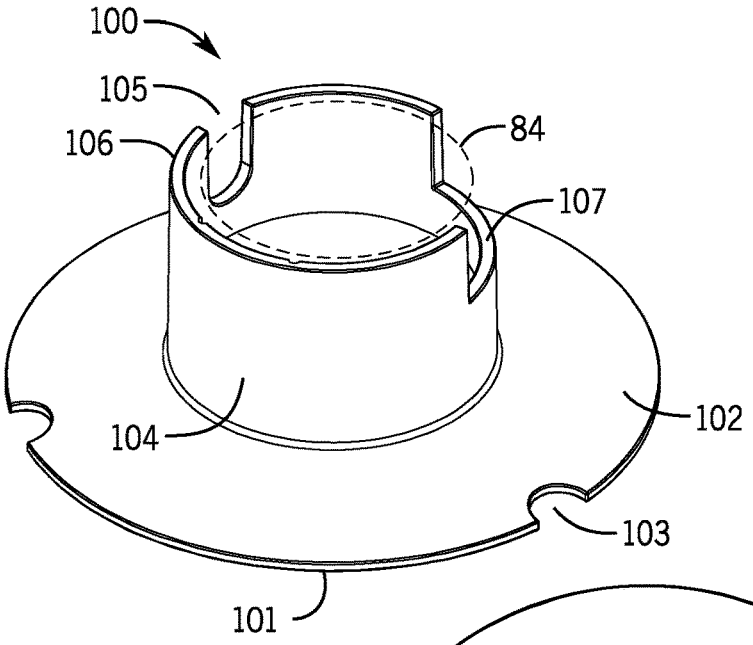
FIG. 17 is a top perspective view of the adjuster used in the tower assembly shown in FIG. 16.
Figure 18:
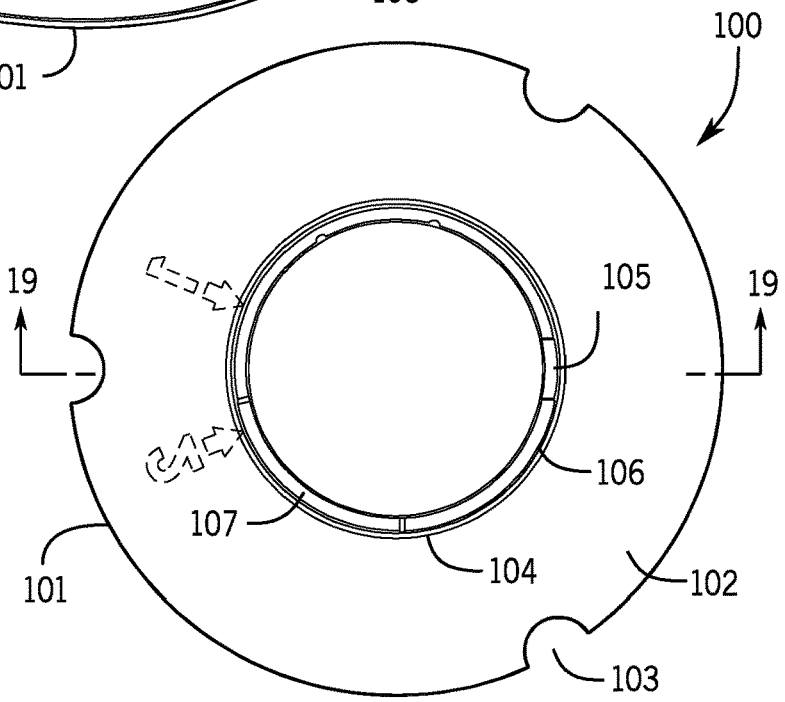
FIG. 18 is a top plan view of the adjuster shown in FIG. 17.

Referring now to FIG. 17, it shows a perspective view of the adjuster 100 that is constructed in accordance with the present invention. This adjuster 100 is a variant of the float base 20 that is used with the open float 12 of the flush valve 10 shown in FIG. 2. As is the case with the void 25 that is created with the embodiment illustrated in FIGS. 2, 3, 6 and 7, the adjuster 100 likewise serves as the bottom boundary of a void 85 as shown in FIG. 16. That is, this configuration is similar to the float base 20 (together with its selectively opened or closed apertures 26) that is used to meter water flow, as well as air flow, through the vertical slot 19. In this embodiment, the adjuster 100 functions with the tower body 80 in such a way that provides at least two positions of operation for controlling water and air flow during a flush cycle.

Figure 19:
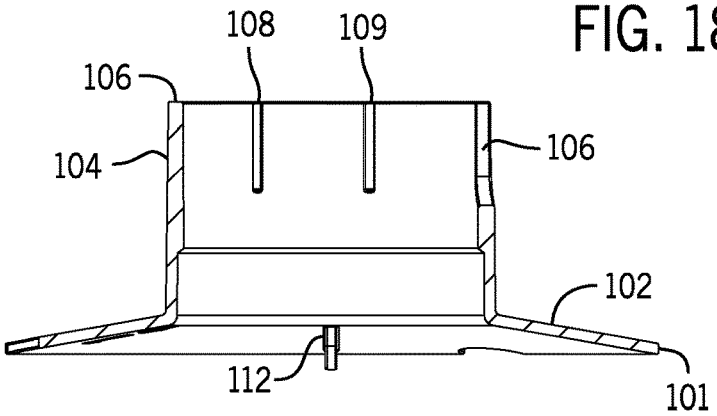
FIG. 19 is a side cross-sectioned view of the adjuster shown in FIG. 17 and taken along line 19-19 of FIG. 18.

More specifically, the adjuster 100 comprises an outwardly extending circular projection 102 and an upwardly extending cylindrical projection 104. The outwardly extending circular projection 102 and the upwardly extending cylindrical projection 104 are a unitary structure. The outwardly extending circular projection 102 starts at the upwardly extending cylindrical projection 104 and tapers downwardly to an outer rim or perimeter 101 having a diameter that is dimensioned to match the walled inner surface 87 which is also cylindrical in shape. A number of openings 103 are disposed along the rim 101. The upwardly extending cylindrical projection 104 has a diameter that is slightly larger than the outer diameter of the inner wall 84 of the tower body 80 such that it can slidably fit over that inner wall 84 and also be limitedly rotatable around that inner wall 84. The upwardly extending cylindrical projection 104 comprises a top rim 106. Extending downwardly from the top rim 106 is first opening 105 and a second opening 107. The second opening 107 is wider than the first opening 105. The first opening 105 is part of an air and water flow control. The second opening 107 is used as one part of a positioning subassembly, the positioning subassembly also relying on complementary structure that is disposed the bottom of the inner wall 84. The inner surface of the upwardly extending cylindrical projection 104 comprises a pair of vertical slots 108, 109 that extend downwardly from the top rim 106. See FIG. 19.

Figure 20:
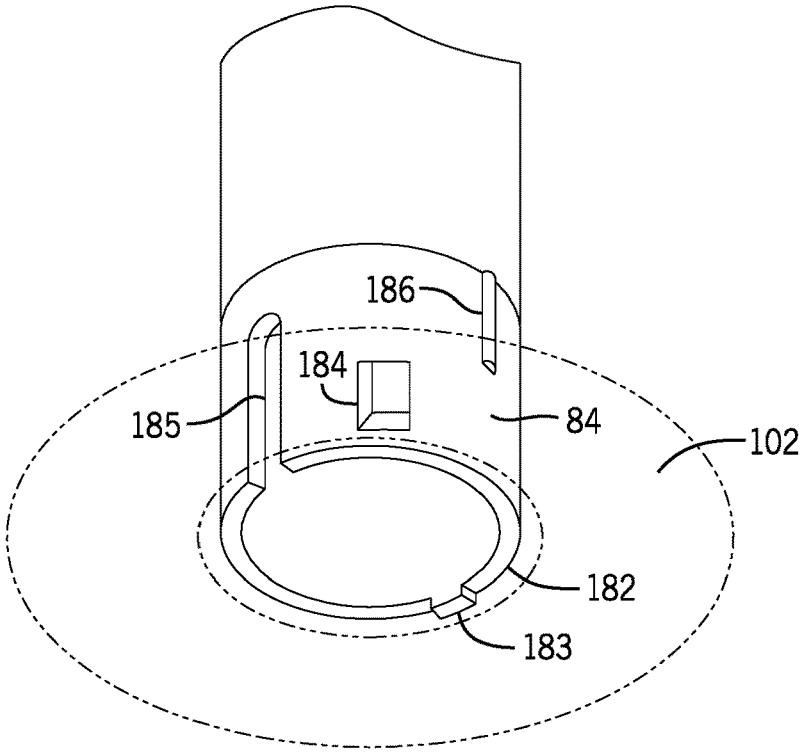
FIG. 20 is a bottom perspective view of the first lower walled portion of the tower body.
Figure 21:
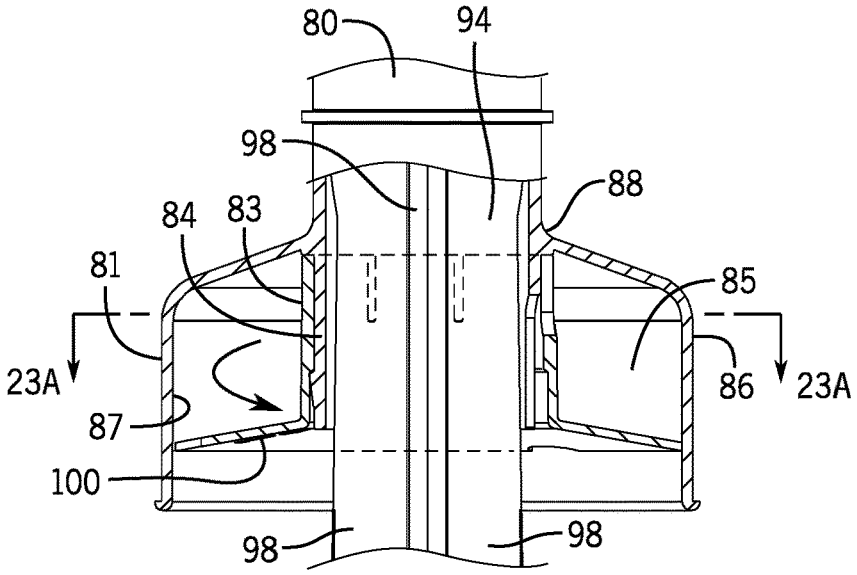
FIG. 21 is a cross-sectioned view showing only the first and second walled portions of the tower body and the adjuster where the adjuster has been rotated from the position shown in FIG. 16.

Referring now to FIG. 20, it will be seen that the bottom of the inner wall 84 comprises a bottom edge 182. An indicator tab 183 extends downwardly and away from the bottom edge 182. A slot 185 extends vertically upwardly and away from the bottom edge 182. The outer surface of the inner wall 84 also comprises a rotation limiting tab 184. The limiter tab 184 is a part of the positioning subassembly and complements the second opening 107 of the upwardly extending cylindrical projection 104 of the adjuster 100. Similarly, the outer surface of the inner wall 84 further comprises an outwardly extending and vertically oriented positioning ridge 186. The positioning ridge 186 is likewise part of the positioning subassembly and complements the vertical slots 108, 109 that extend downwardly from the top rim 106 of the adjuster 100.

Figure 22A:
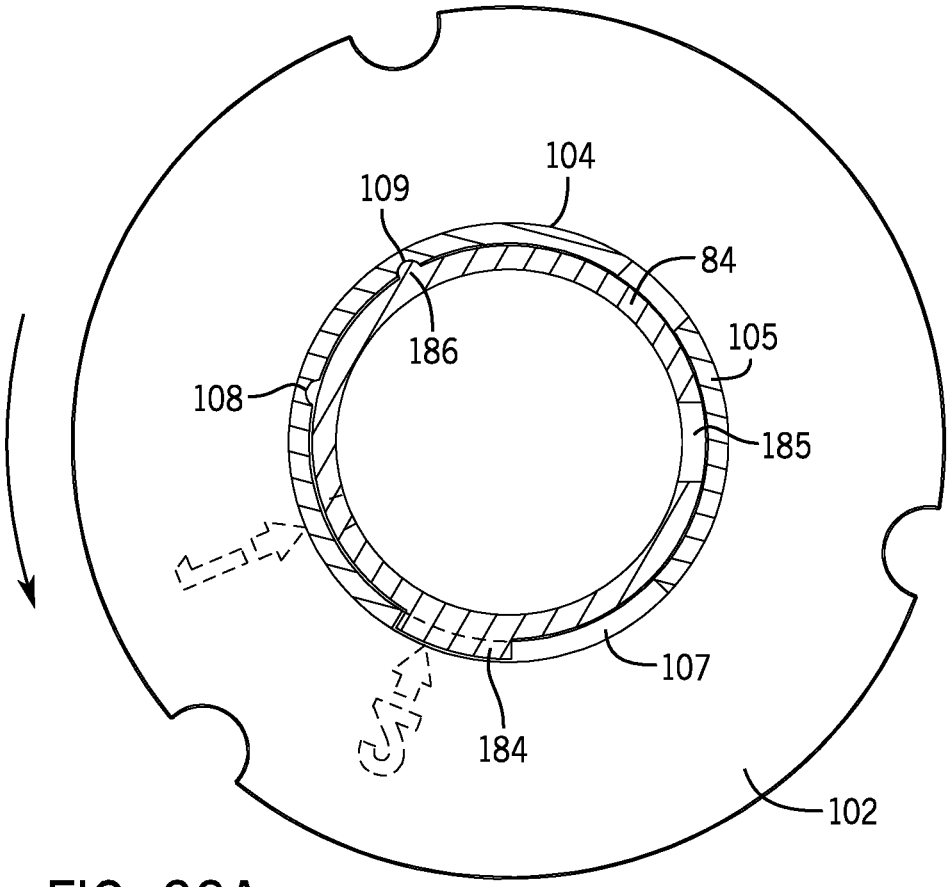
FIG. 22A is an enlarged and cross-sectioned top plan view of the adjuster and the first lower walled portion of the tower body taken along line 22A-22A of FIG. 16.
Figure 22B:
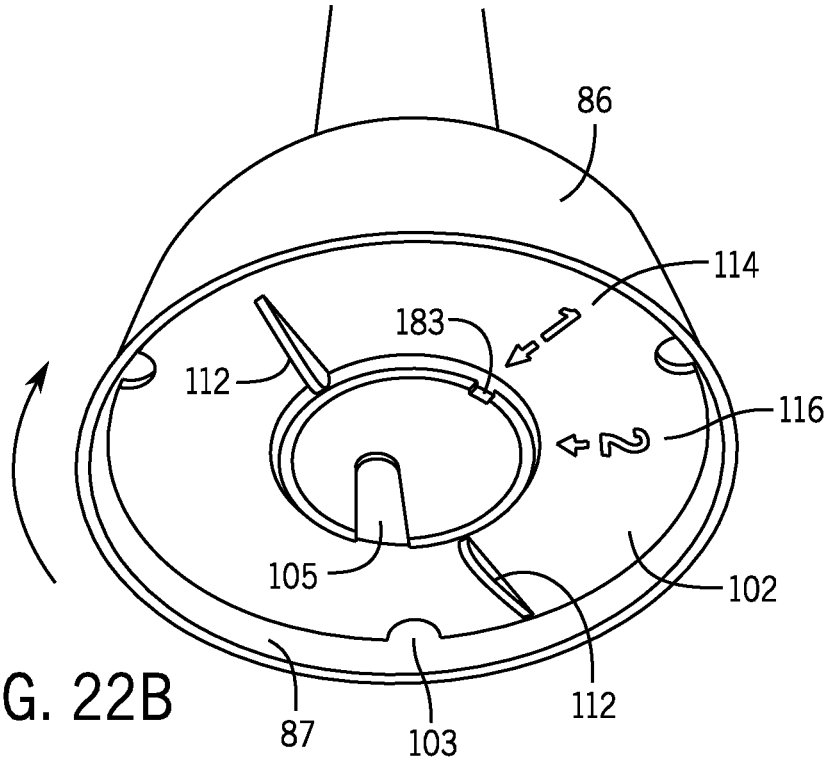
FIG. 22B is a bottom perspective view of the assembled adjuster and tower body in a first position based on the views shown in FIGS. 16 and 22A.

Referring now to FIGS. 22A and 22B, they illustrate the positional relationship between the structures referenced above. Specifically, FIG. 22A is a top plan view of the complementary relationship between the structural elements of the adjuster 100 and the inner wall 84. In this position, it can be seen that the adjuster 100 is in a first position. This first position is indicated to the user via indicia 114 aligned with the indicator tab 183. See FIG. 22B. The adjuster 100 is rotatably movable relative to the inner wall 84 and the inner surface 87 of the outer wall 86. Adjustment is accomplished by the user by urging the rotational tabs 112 disposed at the bottom surface of the outwardly extending circular projection 102 of the adjuster 100. Referring back to FIG. 22A, it will be seen that, in this position, the positioning ridge 186 is received by the vertical slot 109 and the limiter tab 184 is received within the second opening 107. It should be noted that the limiter tab 184 is actually positioned to one side of the second opening 107. Again, this is all part of the positioning subassembly. It should also be noted that, in this "first" position (as per the indicia 114), the slot 105 of the adjuster 100 does not align with the slot 185 that extends upwardly and away from the bottom edge 182 of the inner wall 84. By doing so, water and air are somewhat restricted in their respective flows through the adjuster 100.

Figure 23A:
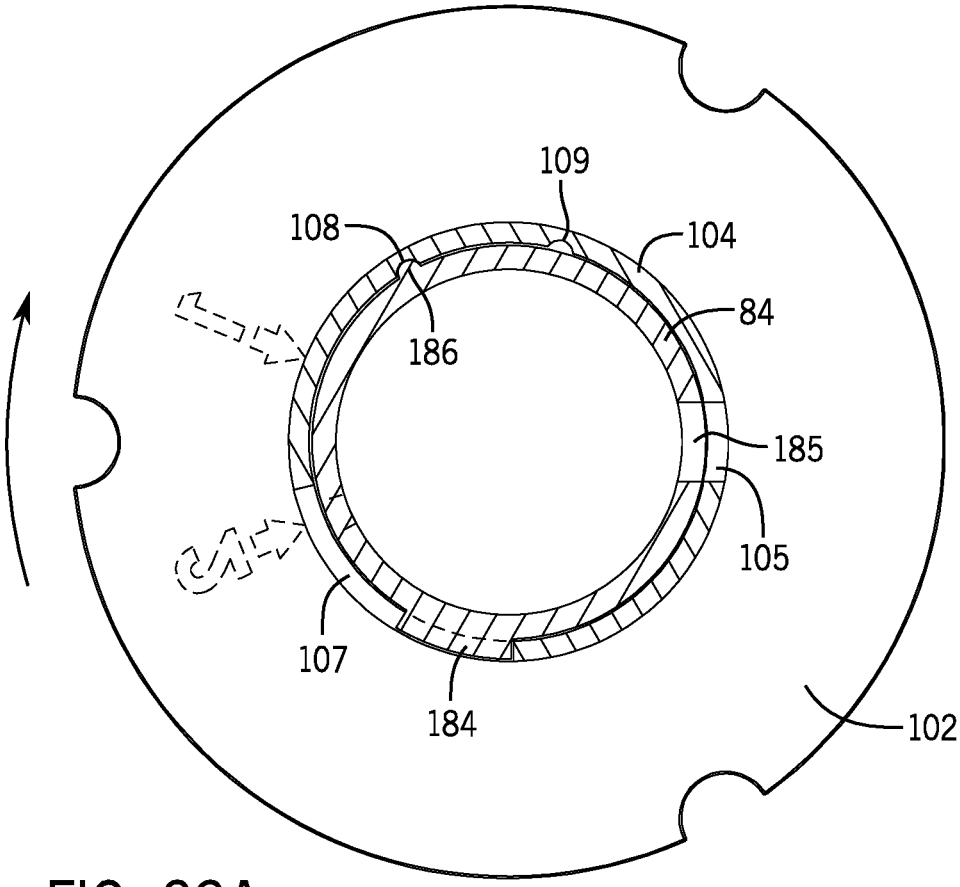
FIG. 23A is an enlarged and cross-sectioned top plan view of the adjuster and the first lower walled portion of the tower body taken along line 23A-23A of FIG. 21.
Figure 23B:
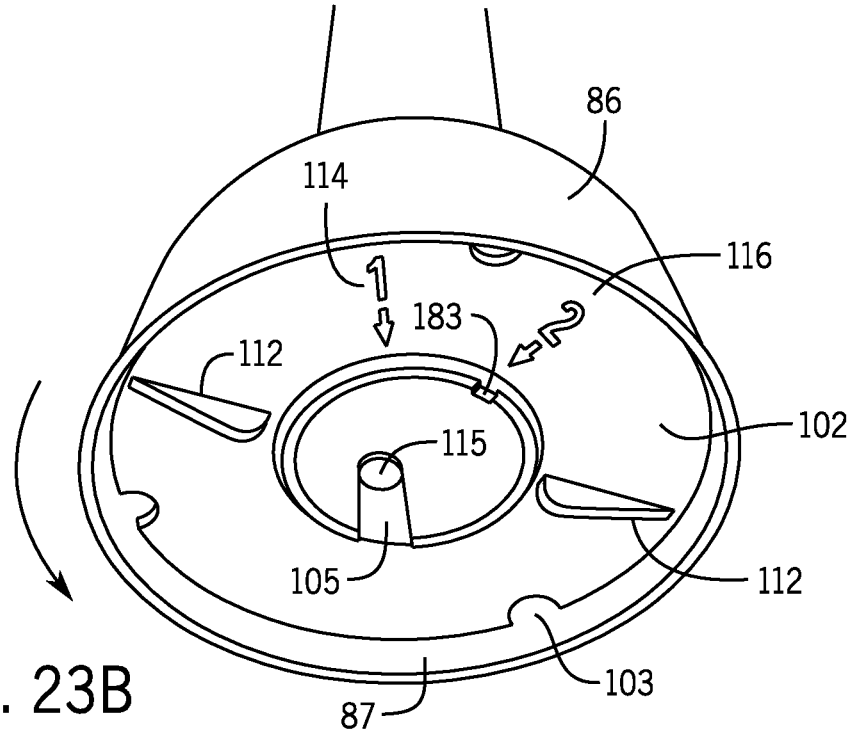
FIG. 23B is a bottom perspective view of the assembled adjuster and tower body in a second position based on the views shown in FIGS. 21 and 23A.

On the other hand, and referring now to FIGS. 23A and 23B, these views show that the user has rotated the adjuster 100 to a second position. This second position is indicated to the user via indicia 116 which is aligned with the indicator tab 183. See FIG. 23B. Referring back to FIG. 23A, it will be seen that, in this position, the positioning ridge 186 is received by the other vertical slot 108 and the limiter tab 184 remains within the second opening 107, but the limiter tab 184 has now been moved to the other side of that second opening 107. In this second position, the slot 105 of the adjuster 100 aligns with the slot 185 that extends upwardly and away from the bottom edge 182 of the inner wall 84. By doing so, water and air are now able to flow through a hole 115 that is created by these overlapping structures during a flush cycle of the toilet.

In the foregoing detailed description of the present disclosure, reference is made to the accompanying drawings that form a part hereof, and in which are shown by way of illustration how examples of the disclosure may be practiced. These examples are described in sufficient detail to enable those of ordinary skill in the art to practice the examples of this disclosure, and it is to be understood that other examples may be utilized and that process and/or structural changes may be made without departing from the scope of the present disclosure.

The elements shown in the various figures herein can be added, exchanged, and/or eliminated so as to provide a number of additional examples of the present disclosure. In addition, the proportion and relative scale of the elements provided in the figures are intended to illustrate the examples of the present disclosure and should not be taken in a limiting sense.

The invention claimed is:

1. An adjustable tower assembly for use with a tower style flush valve comprising:

a tower body comprising:

an upper walled portion;

a first lower walled portion; and a second lower walled portion;

wherein a void is created between the first lower walled portion and the second lower walled portion; and an adjuster comprising:

an outwardly extending circular projection; and an upwardly extending cylindrical projection;

wherein the upwardly extending cylindrical projection has a diameter that is sized to allow the adjuster to slide along a float guide of a tower style flush valve; and wherein the upwardly extending cylindrical projection further comprises a top rim, two openings extending downwardly from the top rim and two slots extending downwardly from the top rim; and wherein the adjuster is positioned within the void; and wherein the first lower walled portion of the tower body comprises:

a bottom edge;

an indicator tab that extends downwardly and away from the bottom edge;

a slot that extends upwardly from the bottom edge;

an outer surface;

a rotational limiting tab disposed on the outer surface; and wherein the adjuster further comprises a bottom surface having positioning indicia disposed on the bottom surface.

2. The assembly of claim 1 wherein:

the indicator tab aligns with the positioning indicia;

the two openings extending downwardly from the top rim complement the limiting tab and the opening of the first lower walled portion; and the positioning ridge complements the two slots extending downwardly from the top rim of the adjuster.

3. The assembly of claim 2 wherein one of the two openings of the adjuster and the opening of the first lower walled portion of the tower are used to meter water and air during a flush cycle through a hole created by these overlapping structures.

* * * * *